United States Patent [19]

Brandl et al.

[11] Patent Number: 4,681,019

[45] Date of Patent: Jul. 21, 1987

[54] MAGAZINE FOR AUTOMATIC WEAPONS

[75] Inventors: Rudolf Brandl, Dornhan-Weiden; Heinz Matt, Oberndorf, both of Fed. Rep. of Germany

[73] Assignee: Heckler & Koch GmbH, Fed. Rep. of Germany

[21] Appl. No.: 684,598

[22] Filed: Dec. 21, 1984

[51] Int. Cl.[4] ..... F41D 10/32

[52] U.S. Cl. ..... 89/33.04; 89/33.14

[58] Field of Search ..... 89/33.04, 33.14, 34

[56] References Cited

U.S. PATENT DOCUMENTS

| | | | |
|---|---|---|---|
| 2,489,428 | 11/1949 | Mariner | 89/33.14 |
| 3,076,386 | 2/1963 | Wey | 89/33.04 |
| 4,252,049 | 2/1981 | Franz et al. | 89/34 |
| 4,434,701 | 3/1984 | Voillot | 89/34 |
| 4,450,750 | 5/1984 | Gillum | 89/33.04 |

FOREIGN PATENT DOCUMENTS

| | | |
|---|---|---|
| 2839839 | of 0000 | Fed. Rep. of Germany . |
| 3219800 | of 0000 | Fed. Rep. of Germany . |

*Primary Examiner*—Harold D. Whitehead

[57] ABSTRACT

A magazine for automatic weapons exhibits an endless chain for storing cartridges. Provided in the vicinity of a delivery opening of the magazine is an additional storage chamber from which further cartridges can be fed simply and quickly into the chain.

3 Claims, 12 Drawing Figures

MAGAZINE FOR AUTOMATIC WEAPONS

BACKGROUND OF THE INVENTION

The invention relates to a magazine for automatic weapons with an endless chain.

A belt feed unit for automatic weapons with a single endless chain is known from German patent specification No. 28 39 839. The chain can, if so desired, be loaded with two different types of cartridge. To fire one type of cartridge, the chain is driven in one direction, and if another type of cartridge, likewise loaded in the chain, is to be fired, the chain is driven in the other direction in order to feed these other cartridges to the weapon. Depending on how many cartridges of the first type have already been fired, it is necessary when switching to the second type of cartridge to move a more or less large part of the already emptied chain past the delivery opening of the magazine, from where the cartridges are fed to the weapon, before the first cartridge of the other type can be fired.

A device for feeding ammunition to an automatic weapon is known from the German pending patent application No. 32 19 800 whereby the device exhibits two endless chains. One chain conveys cartridges from a drum magazine to the weapon, and the other chain conveys cartridges from a plurality of shafts to the weapon. If a switch is to be made from one type of cartridge to the other type of cartridge, this is done by the chains being shifted accordingly by an adapter which deflects the two chains in the region of the weapon.

SUMMARY OF THE INVENTION

The object of the invention is to create a magazine for automatic weapons, said magazine requiring only one single endless chain and making it possible, when all cartridges of the chain have been fired, for further cartridges to be fed simply and quickly into the chain so that these further cartridges can be fired.

The object of the invention is achieved in that a magazine for automatic weapons exhibits the following features:

An endless displaceably guided chain for storing cartridges, said chain exhibiting pockets for cartridges whereby the cartridges are conveyable by the chain in a predetermined feeding direction to a delivery opening of the magazine, an additional cartridge storage chamber, one end of which facing the chain exhibits a blocking device and from which further cartridges contained in the additional storage chamber are able to enter cartridge-free pockets in the chain if the blocking device opens the path of the further cartridges to the chain, whereby the aforementioned end of the storage chamber is at a distance of maximum 15 chain pockets from the delivery opening of the magazine, whereby the additional storage chamber exhibits a filler opening which is closable by a closing device, and whereby the filler opening is disposed at a lateral distance from the delivery opening so that the filler opening is always accessible for the firer, and an actuating device in order to move the chain back against the feeding direction which the chain has when conveying cartridges to the delivery opening.

The aforementioned cartridge-holding pockets of the chain can most simply be formed in known manner by the spaces between ladder-like bars of the chain, whereby the bars extend transversely to the longitudinal direction of the chain. However, it is also possible to use other known holding devices of chains.

The advantage of the invention is that, when all cartridges of the chain have been fired, the firer is able, by means of the actuating device, to move the chain back against the feeding direction the chain has when firing, whereby the firer simultaneously opens the blocking device. As soon as empty pockets of the chain come into the region of the aforementioned end of the storage chamber, the further cartridges can be fed from the storage chamber into the chain. It is preferable for this feeding operation to be performed through the force of gravity. In this respect, it is beneficial if, viewed from the chain with the weapon in its normal ready-to-fire position, the storage chamber extends in an upward direction. In the later described specimen embodiment, it extends diagonally upward. If, as preferred, use is made of chains with ladder-like bars between which the cartridges are held, the further cartridges can drop without difficulty out of the additional storage chamber into the space between two bars. As soon as the firer has fed either all the further cartridges contained in the storage chamber or a desired number into the chain in the above-depicted manner by turning back the chain, he causes the chain to be moved again in the predetermined feeding direction which it has when firing until the first of the newly fed-in cartridges is at the delivery opening of the magazine for being loaded into the weapon.

If the further cartridges contained in the additional storage chamber are of the same kind as the cartridges originally stored in the chain, this storage chamber represents a reserve capacity and gives the firer the assurance that, after the cartridges stored in the chain have been fired, his weapon will continue to be ready to fire. However, the invention also allows cartridges of the same caliber, but of a different type, to be filled into the additional storage chamber. In this case, the invention permits the firer to change quickly between two different types of cartridge when firing.

The further cartridges contained in the additional storage chamber are protected against becoming dirty or dropping out by the fact that the filler opening of the additional storage chamber is normally closed by a closing device, in the simplest case, for example, by a hinged lid.

An advantage of the invention is that the firer can fill further cartridges into the additional storage chamber without having to remove the magazine from the weapon. The filling in of cartridges can be facilitated by a support for a charger clip being available when the closing device is open. This support may be provided on the inside of the aforementioned lid.

In an embodiment of the invention, a device is provided for driving the chain at least in the backward direction (i.e. against the feeding direction when firing) by hand. This allows the magazine to be of particularly simple design.

In an embodiment of the invention, the magazine exhibits its own drive motor for the chain. Every kind of drive motor is conceivable, e.g. an electric motor, spring motor, hydraulic motor. This drive motor may advantageously be a spring drive. Such embodiments make it possible easily to adapt the design of the magazine to existing weapons. For example, it is possible in this manner to design a magazine according to the invention for a machine gun whereby the machine gun exhibits a removable belt feed unit which uses gearwheels to feed the cartridge. If the belt feed unit is removed, the magazine according to the invention which has its own drive motor can be mounted on the weapon. In this way, the magazine according to the invention can be used, for example, for the HK 21 A1 machine gun made by Heckler & Koch GmbH. This, however, is only one of many possible applications.

This provides the advantage that, after having moved back the chain by means of the actuating device in order to feed in the further cartridges, the firer need merely release this actuating device, as a result of which the drive motor then moves the chain again in the predetermined feeding direction until one of the further cartridges is at the delivery opening of the magazine for firing.

It is deemed advantageous for the capacity of the additional storage chamber to be such that it can hold at least ten cartridges. A normal charger clip generally contains ten cartridges. Approximately 25% of the capacity of the chain is deemed for many applications to be a practical upper limit for the capacity of the additional storage chamber. In the magazine described in the specimen embodiment, the chain holds two hundred cartridges, so that, in such a case, the capacity of the additional storage chamber may be at most about fifty cartridges. In the specimen embodiment, however, the capacity is smaller.

Described below with reference to the drawings are specimen embodiments of the invention.

DESCRIPTION OF THE PREFERRED EMBODIMENTS

Figure 1:
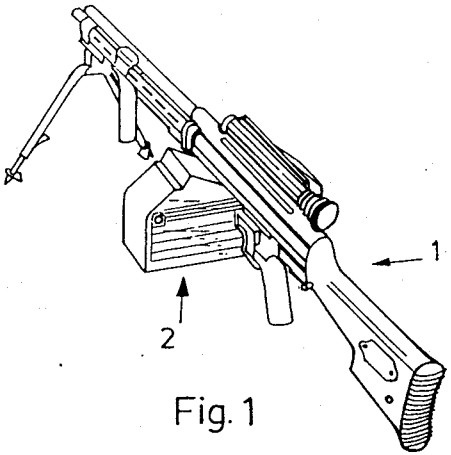
FIG. 1 is a view of a machine gun with a magazine according to the invention mounted in place.

FIG. 1 is a perspective view, obliquely from the rear, of a machine gun 1 on which is mounted a magazine 2 according to the invention.

Figure 2:
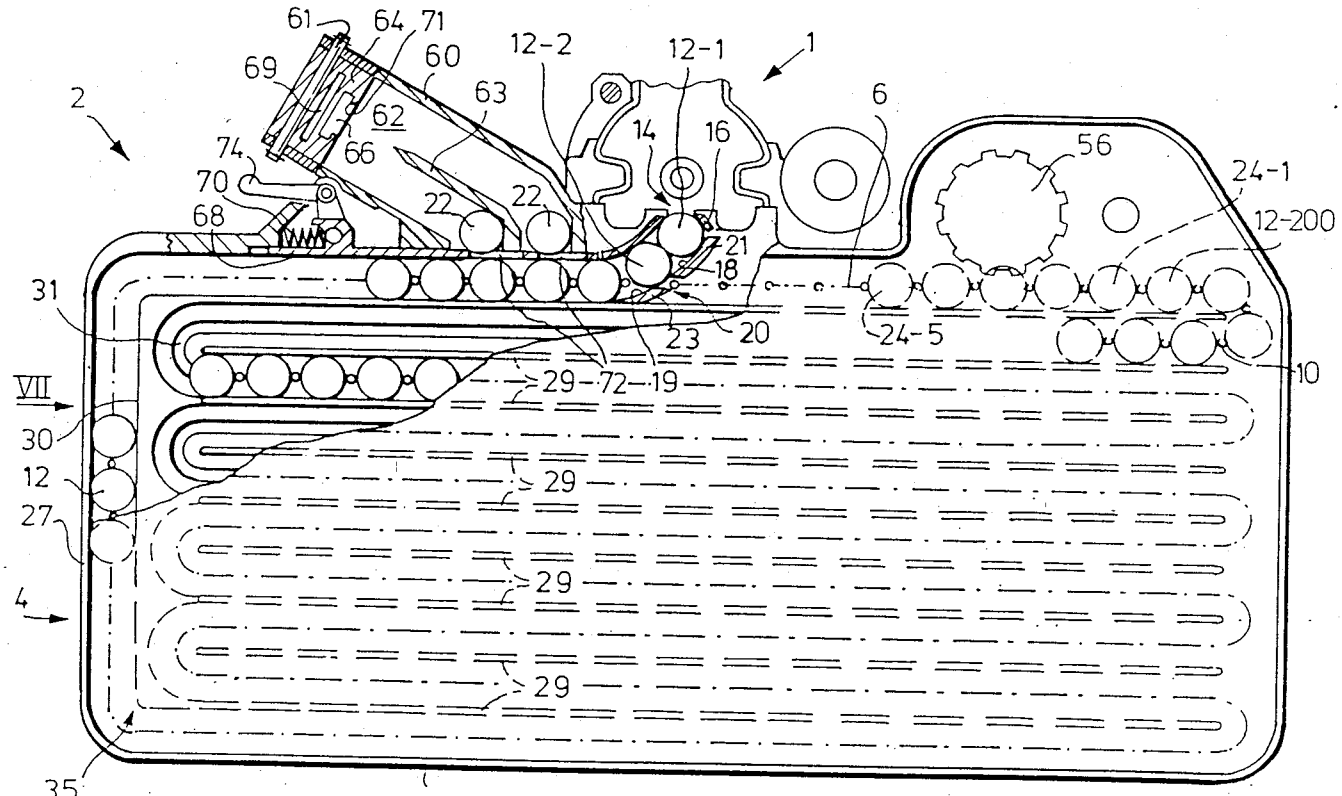
FIG. 2 is a rear view of a magazine mounted on a machine gun whereby some parts are shown as a cutaway and in section and also parts of the machine gun are shown.

The magazine 2 exhibits a housing 4 which, as viewed from the rear (see FIG. 2), has the shape of a rectangle which is adjoined at the top by further parts. An endless chain 6 is guided in the housing 4 such that it is displaceable in its longitudinal direction. The chain 6 exhibits flexibly connected chain links 8, 8*a* and 9 as well as bars 10 which extend transversely to the longitudinal direction of the chain 6 and which are manufactured from plastic in one piece with the chain links 8*a*. See also FIGS. 8 and 9. The clear gap between the bars 10 is just big enough for a cartridge 12 to be accommodated between them. In FIG. 2 the chain 6 of the magazine is filled to capacity and a cartridge 12-1 is at a delivery opening 14 of the magazine where it is held by lips 16 to prevent it from dropping out. When the weapon is in operation, however, the cartridge can be loaded from the magazine into the weapon by means of a displacing motion perpendicular to the plane of projection of FIG. 2. The cartridge 12-1 has already left the region between two adjacent bars 10 of the chain 6, and the cartridge 12-2 directly following it is also only in contact with one of the bars 10 on one side. The cartridges 12-1 and 12-2 have been moved upward out of the chain 6 by oblique flats 18 and 19 which are disposed essentially under the delivery opening 14. Provided between the flats 18 and 19 is a space 20 through which the bars 10 can pass. Including the cartridges 12-1 and 12-2, the chain 6 contains a total number of two hundred cartridges 12 which are not all shown. The last cartridge 12-200 to be fired is followed in the chain by several (five in the example) dummy cartridges 24 which are captive in the chain. When filling the chain 6 with cartridges, the chain cannot be turned back indefinitely because the last dummy cartridge 24-5 comes up against the side of the wall parts 21 and 23 opposite the oblique flats 18 and 19, said wall parts forming a stop for the dummy cartridge.

Starting at the point at which the dummy cartridges 24 are shown in FIG. 2, the endless chain 6 passes through the interior of the housing 4, initially on a meandering path, until the chain finally moves along the bottom 26 to the left and moves upward in the region of the left-hand side wall 27 and then moves to the right on a straight path. The chain 6 filled with the cartridges 12 is guided by guide grooves 31 in the two walls 35 extending parallel to the plane of projection in FIG. 2. These guide grooves 31 are engaged by the chain links 8. The guide groove 31 is not shown in full. The cartridges are held in the chain 6 by the walls of the magazine and by guide ribs 29 extending parallel to the bottom as well as a guide 30 extending parallel to the left-hand side wall 27.

Figure 4:
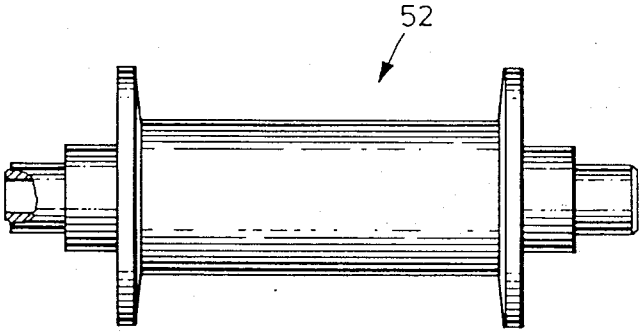
FIG. 4 is a side view of the supply roll of the spring drive.
Figure 6:
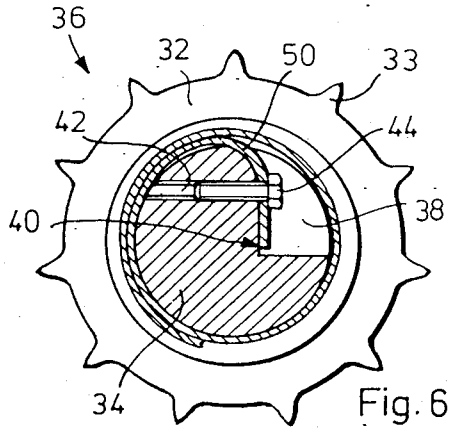
FIG. 6 is a section on line VI—VI in FIG. 5 complete with screws and spring.
Figure 5:
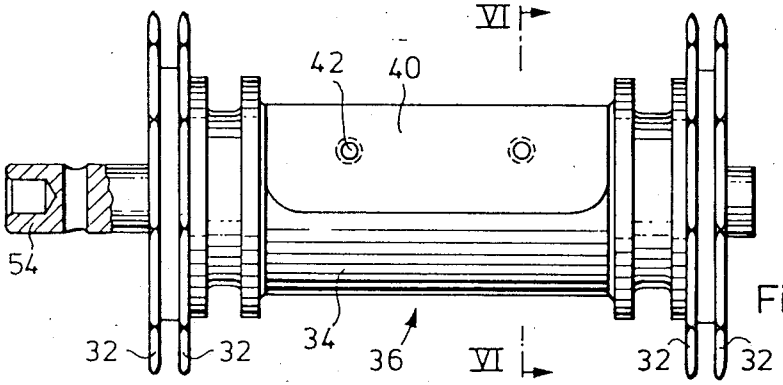
FIG. 5 is a side view of the drive wheel of the spring drive without screws and spring.
Figure 3:
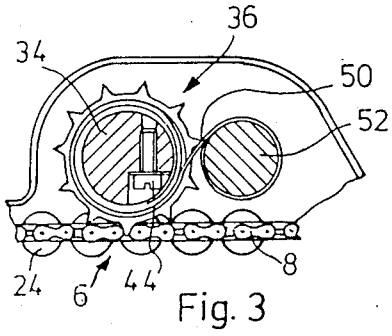
FIG. 3 is a detail of the spring drive in the same viewing direction as FIG. 2, partly shown in section.

Four chain wheels or sprocket wheels 32 each with eleven teeth 33 and a shaft 34 connecting them form together a one-piece chain drive wheel 36. It was also possible to provide a different number of teeth. The sprocket wheels 32 are arranged in two pairs, there being a small space between the sprocket wheels of either pair, and it is between these two pairs of sprocket wheels that the shaft 34 essentially lies. The teeth 33 of the four sprocket wheels 32 engage the space between adjacent chain links 8 and between adjacent chain links 8*a* in the region of both ends of the bars 10 of the chain 6. The chain drive wheel 36 is held in the upper part of the housing 4 in FIG. 2 to the right of the weapon. The shaft 34 is provided with a cutout 38 which, as shown in FIGS. 3 to 6, is essentially limited by flat surfaces. Provided in the flat 40 are threaded holes 42 into which are screwed screws 44 which hold one end of a spring 50 which is in the form of a scroll spring. The spring is wound onto the shaft 34 and its other end is attached to a shaft 52 which is disposed parallel to the drive wheel 36 and is rotatably held in the housing 4. The spring 50 has a tendency to wind itself onto the shaft 52 which exhibits a smaller diameter than the shaft 34. Consequently, the spring 50 unwinds from the shaft 34, and this is only possible if the shaft 34 and thus the entire drive wheel 36 are turned in a counterclockwise direction as shown in FIG. 3. As a result, the thus formed spring motor conveys the chain 6 to the right as shown in FIG. 3. FIG. 6 shows the spring 50 in a truncated view.

On the whole, the spring 50 runs in an S-shape between the shaft 34 and the shaft 52 whereby it is wound onto the shaft 34 opposite to the direction of curvature which it tends to assume when relaxed.

An extension 54 of the drive wheel 36 penetrates the housing wall facing the observer in FIG. 2. Attached at this point to the extension 54 is a rotary knob 56 which allows the firer, by turning in a clockwise direction, to move the chain 6 back against its driving direction which it executes during firing and which is caused by the spring 50.

Situated in the region of the upper side of the magazine (FIG. 2) to the immediate left of the weapon 1 is a shaft 60 which extends basically diagonally to the top left and whose interior forms an additional storage chamber 62 for the further cartridges 22, said storage chamber 62 being divided in the lower region by a dividing wall 63. The additional storage chamber 62 is sealed by a lid 64 on its side facing away from the interior of the magazine 2. The lid 64 is hinge-mounted. On its inside the lid 64 exhibits a guide groove 66 into which, when the lid 64 has been hinged up through approximately 90°, a charger clip, containing for example ten cartridges, can be inserted. The cartridges of this charger clip can then easily be pressed out with the thumb and thus be conveyed into the interior of the additional storage chamber 62.

The end of the further storage chamber 62 facing the housing 4 is sealed by a slide 68 forming a blocking device. This slide 68 is held in its closed position by a spring 70. The slide 68 exhibits two parallel slits 72 extending perpendicularly to the plane of projection in FIG. 2, such that, when the slide 68 has been moved only by a small distance to the left, the further cartridges 22 are able to proceed from the additional storage chamber 62 into the chain 6 when the chain exhibits cartridge-free pockets. The slide 68 can be moved by the firer by a swivel-mounted two-arm lever 74, one end of which projects outwardly in the vicinity of the lid 64. With the slide 68 in the blocking position, the slide 68 forms a part of the guide for the cartridges being conveyed by the chain 6, so that the cartridges cannot leave the chain 6 and enter the additional storage chamber 62.

In the example, the capacity of the additional storage chamber 62 is ten cartridges.

Due to the fact that the shaft 60 extends toward the top left (in the view in FIG. 2) starting from that region in which the further cartridges 22 are able to be fed into the chain 6, the lid 64 is easily accessible to the firer even when the magazine is mounted on the weapon and the weapon is in a ready-to-fire position similarly to FIG. 1, and the lower end of the shaft 60 is still able to lie tightly up against the delivery opening 14 which is situated under the weapon. Due to the fact that, with the weapon held normally, the end of the shaft 60 which is sealed by the lid 64 is higher than the other end, the further cartridges 22 drop into the chain under the influence of gravity.

Figure 11:
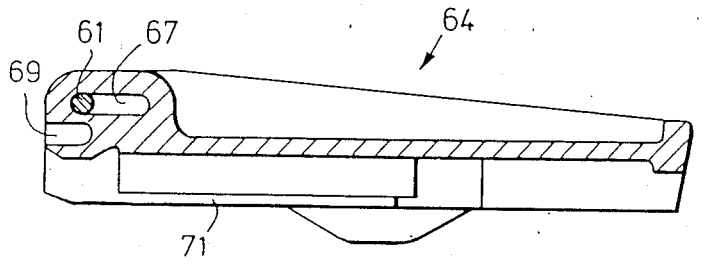
FIG. 11 is a longitudinal section of the lid of the additional storage chamber.

When the firer desires to fill cartridges into the additional storage chamber 62 with a charger clip, he opens the lid 64 about 90 degrees and then blocks the lid in this position. For this purpose, the lid 64 is mounted on the pin 61 by means of an oblong hole 67. The lid 64 has a slot 69 at its left end, as seen in FIG. 11, and with this slot 69 the lid 64 can be shifted onto a projection provided at the shaft 60, which projection exactly fits into the slot 69 and, therefore, holds the lid 64 in the open position. The mentioned projection is not shown in the drawings for reasons of simplifying the drawings. When the lid has been swivelled exactly about 90 degrees into the open position, the lid is shifted in its lengthwise direction towards the shaft 60, which shifting is possible because of the oblong hole 67.

If the firer does not block the lid 64 in the just described manner, he is able to open the lid completely by swivelling it about 180 degrees. In this position of the lid, the firer can easily fill loose cartridges, that are cartridges not contained in a charger clip, into the shaft 60. FIG. 11 also shows one of the two strip-like projections 71, which positively hold the charger clip in the guide grove 66 of the lid 64.

When, in the specimen embodiment, the chain 6 has been entirely emptied, i.e. when there are no cartridges in it, the foremost dummy cartridge 24-1, which is captively, yet swivellingly attached to the bar 10 behind it by the hooks 87, is pushed up slightly in the direction of the delivery opening 14 and is thereby in contact with the oblique flat 18. The four other dummy cartridges are directly to the left of the foremost dummy cartridge 24-1 (in FIG. 2), thereby also blocking the path from the additional storage chamber 62 to the chain. If the firer now desires to load further cartridges 22 from the additional storage chamber 62 into the chain, he opens the slide 68 and turns the rotary knob 56 in a clockwise direction, and, as a result, the chain 6 is moved back opposite to the feeding direction in which it moves when firing. As soon as the foremost dummy cartridge has been moved back by (in the specimen embodiment) three cartridge widths, the right-hand part of the lower opening of the additional storage chamber 62 is completely free and it is now possible for a further cartridge to drop into the chain. If the firer now continues to turn the rotary knob 56 in a clockwise direction, the chain will be moved back further, as a result of which more empty pockets of the chain come into the region of the additional storage chamber and are filled with further cartridges. When the right-hand part of the additional storage chamber lying above the dividing wall 63 contains no further cartridges, it is possible for furher cartridges to drop into the chain from the left-hand part of the additional storage chamber. If the firer now releases the rotary knob 56, the chain is moved forward again by the spring 50 until one of the cartridges is up against the lips 16.

It is deemed advantageous if the distance between the delivery opening 14 of the magazine and the lower end of the shaft 60 is not too great, but preferably only a few cartridge widths. This is because, then, the firer need turn back the chain only relatively little in order to convey further cartridges from the additional storage chamber into the chain. In this way, he is able to load the chain quickly with some further cartridges.

In the specimen embodiment, it is intended that the magazine 2 be loaded only by way of the shaft 60. It may be practical to use auxiliary devices which prevent the chain from being moved forward again when the rotary knob 56 is released. Even if this happens, however, this does not matter because, even if, for example, with the chain half-loaded the foremost cartridge is up against the lips 16, just a small turn, half a turn in the example, of the rotary knob is sufficient to bring free pockets of the chain underneath the further storage chamber 62 and in this way to fill them.

Figure 7:
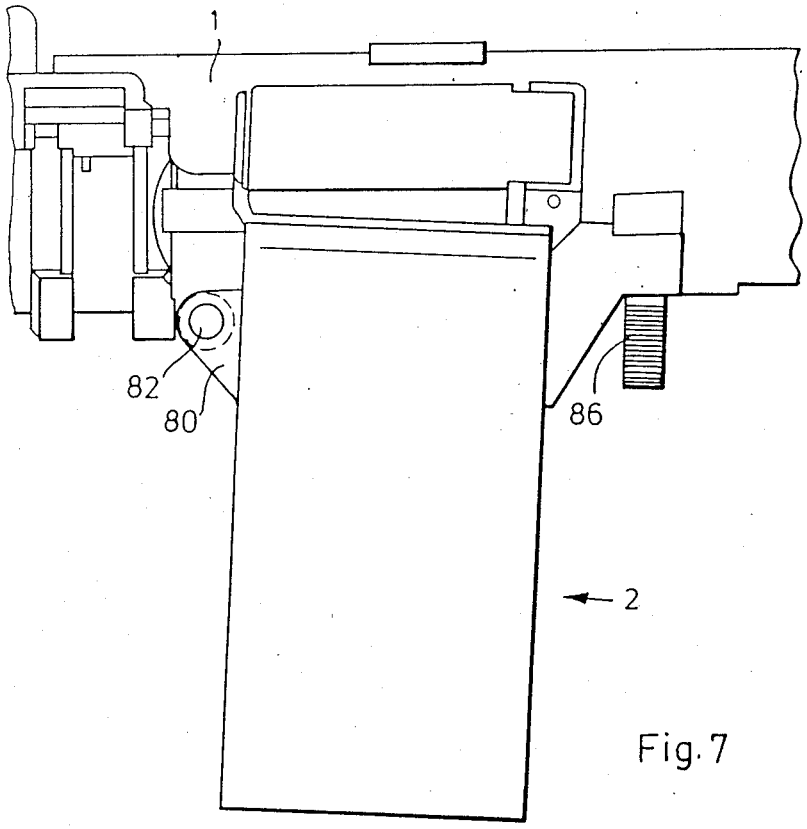
FIG. 7 is a view in the direction of arrow VII in FIG. 2 which shows how the magazine is mounted on the machine gun.

FIG. 7 shows how the magazine 2 is attached to the machine gun 1. In its front upper region the magazine 2 exhibits two spaced-apart eyes 80 (only one eye is visible) through which is inserted a socket pin 82 which penetrates a recess provided on the machine gun 1. In the rear region the magazine 2 exhibits a pivoting catch 86 which engages a projection on the weapon 1. If the firer wishes to remove the magazine 2 from the machine gun 1, he first of all releases the catch 86 and is thus able to pivot the magazine downward and forward about the socket pin 82. He then pulls out the socket pin 82 and can thus completely remove the magazine 2 from the machine gun 1. The same attaching parts on the weapon which are provided for attaching the magazine 2 are also used for attaching a belt feed unit (not shown) which is used for firing belted ammunition.

Figure 8:
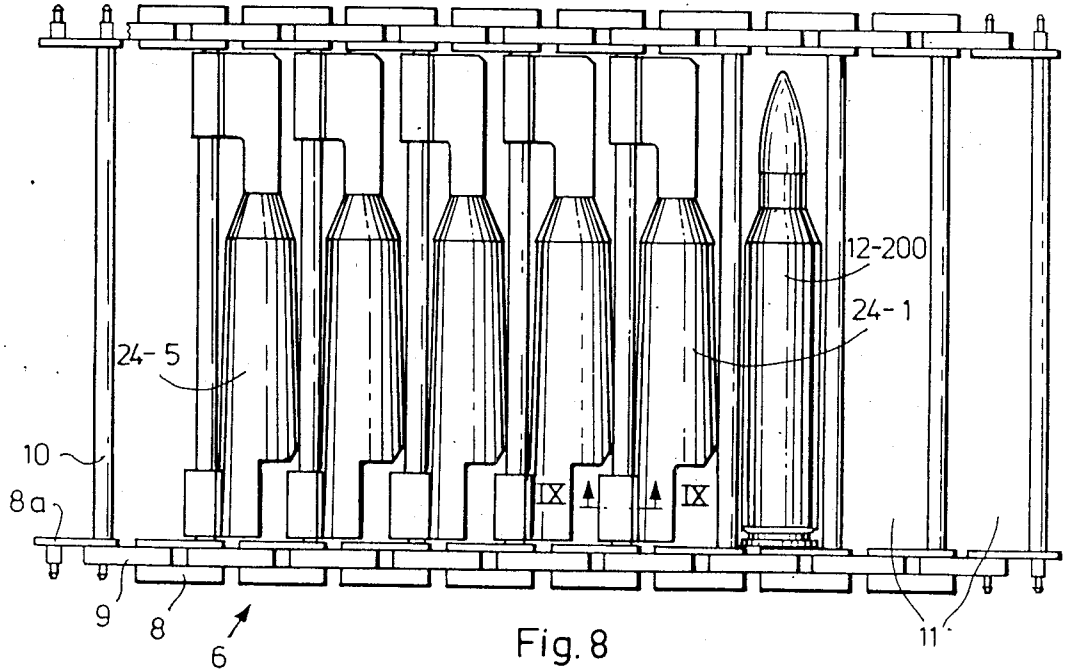
FIG. 8 is a top view of a part of the chain, partially truncated.
Figure 9:
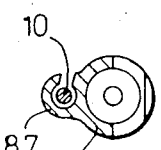
FIG. 9 is a section on line IX—IX in FIG. 8.

FIG. 8 shows a top view of a part of the chain 6 in which the chain links 8, 8*a* and 9, the bars 10, an empty space 11 in the chain (hitherto referred to as pocket), a cartridge 12 held in the chain, and the five dummy cartridges 24 are shown. FIG. 9 shows the captive attachment of the dummy cartridges. Flexible hooks 87 of the dummy cartridge 24 positively engage a bar 10 of the chain. When shooting, the chain 6 moves to the right in FIG. 8.

Figure 10:
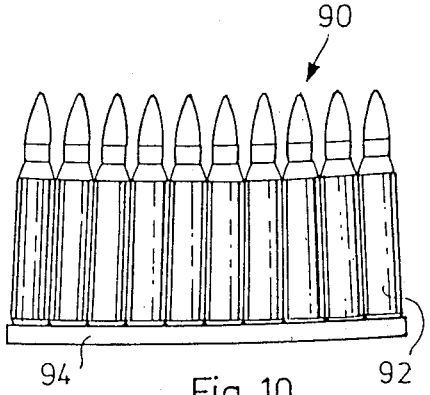
FIG. 10 is a side view of a charger clip.

FIG. 10 is a side view of a filled charger clip. The latter contains a number of cartridges 92 which are held in a charger clip 94. The charger clip 94 can be inserted in the guide groove 66 of the lid 64. If the cartridges 92 have been filled into the additional storage chamber 62, these are then the aforementioned further cartridges 22. The charger clip filled with cartridges has the reference numeral 90.

If the additional storage chamber contains a different type of cartridge (e.g. armour piercing ammunition) from that in the chain, the firer can, when some of the cartridges stored in the chain have been fired, feed this other type of cartridge into the chain by turning back the chain 6 by means of the rotary knob 56 without essentialy changing his ready-to-fire position. After the rotary knob 56 has been released, these fed-in cartridges of the other type immediately reach the delivery opening 14 of the magazine and can then be fired before all other cartridges 12 stored in the chain. This allows a fast change between two different types of ammunition.

The design of the machine gun 1 is largely identical with the initially mentioned known machine gun of type HK 21 A1 with the essential difference that the machine gun 1 has a smaller caliber, being intended for a cartridge of .223 caliber.

The width of the magazine 2 visible in FIG. 2 is 277 mm; the overall height from the bottom to the upper end of the shaft 60 is approximately 173 mm. The thickness of the housing 4 of the magazine (visible in FIG. 7) is 72 mm. The remaining dimensions can be taken from the scale drawings. The wall 35 visible in FIG. 2 is made from transparent plastic so that the firer can always see how many cartridges are left in the chain 6 and the additional storage chamber 62.

In the specimen embodiment, the dummy cartridges 24 ensure that the spring 50 cannot relax entirely when the magazine is empty. Namely, the dummy cartridge 24-1 which is in contact with the oblique flats 18 and 19 when the magazine is empty, forms a stop which is connected to the chain 6 and which prevents the spring drive from being able to drive the empty chain 6 in the feeding direction until the spring 50 is completely relaxed. When the chain is filled through the shaft 60, the last dummy cartridge 24-5 likewise forms a stop which is connected to the chain. This stop, for example, ensures that the rotary knob 56 cannot be turned indefinitely in a clockwise direction, as a result of which the spring 50 might be overtensioned and destroyed. Dummy cartridges following the first dummy cartridge 24-1 block the path from the additional storage chamber 62 to the chain when the magazine is empty in order to prevent further cartridges 22 from being able to drop into an area of the chain from which they could not be fired.

In the specimen embodiment, the drive motor has a drive connection to the chain 6 without the provision of a slipping clutch inbetween.

If, for example, an electric motor is used, it would not be absolutely necessary to provide one or more dummy cartridges in the chain. If, in such a case, the magazine is empty and is to be filled through the shaft 60, the electric motor is switched on so that the chain continuously runs backward, i.e. is moved in the same direction as when the rotary knob 56 is turned in a clockwise direction (FIG. 2). As the chain runs backward, the cartridges are fed into the chain through the shaft 60. As soon as the first thus fed-in cartridge abuts on the wall parts 21 and 23, the chain is full. It is practical to provide a slipping clutch which prevents excessive impacting on the wall parts 21 and 23. Furthermore, it is practical to provide a means for switching off the electric motor when the aforementioned slipping clutch slips.

In this case, as in the specimen embodiment which has been described, the drive wheel 36 is so designed that cartridges and dummy cartridges can pass under it.

Figure 12:
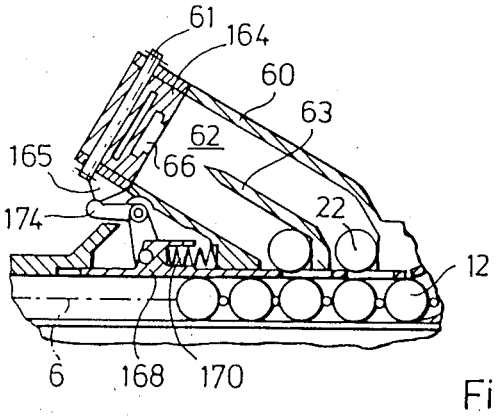
FIG. 12 is a detail of another embodiment.

FIG. 12 shows a detail of another embodiment which differs from the above described embodiment only with respect to the manner in which the slide is actuated which blocks the way of the further cartridges 22 to the chain 6. Whereas in the above described embodiment this slide is actuated by hand and is not coupled with the lid 64, in the embodiment shown in FIG. 12 a coupling is provided between the lid 164 and the slide 168. The spring 170 is arranged differently from the spring 70 in FIG. 2 and tends to move the slide 168 into the open position in which the way of the further cartridges 22 to the chain 6 is free. When the lid 164 is closed, a cam 165 provided on the lid 164 presses onto the lever 174, the free arm of which is shorter compared to the lever 74 of FIG. 2, and thereby holds the slide 168 in its blocking position. If the lid 164 is being opened, the cam 164 releases the lever 174 and, therefore, the spring 170 is able to move the slide 168 into the open position. Therefore, the slide 168 is open whenever the lid 164 is open. When the lid 164 is being closed, the cam 165 presses onto the lever 174 and closes the slide. The lever 174 has a thicker end which forms a latch for the cam 165 and, therefore, for the lid 164. The embodiment according to FIG. 12 may be advantageous if it is intended to quickly load greater quantities of cartridges into the chain 6, for example the cartridges of a plurality of charger clips.

What is claimed is:

1. A magazine for use with an automatic firearm having means for receiving cartridges for firing, said magazine comprising an endless chain having cartridge carrying pockets for conveying cartridges toward a delivery opening when the chain is driven in one direction, a housing defining a path for said chain and the cartridges carried therein, said housing having a top wall defining said delivery opening so that cartridges can move upwardly to be received by said firearm receiving means, an auxiliary cartridge magazine for storing additional cartridges outside said path, said auxiliary magazine having a discharge end adjacent an auxiliary opening in said top wall, a movable closure below said discharge end to prevent additional cartridges from dropping into pockets of said chain without cartridges, and manually operable means for reversing said chain direction and moving said closure to permit an additional cartridge to drop into a pocket of said chain by gravity when no cartridge is present in that pocket of said chain that is present below said auxiliary opening.

2. The magazine of claim 1 wherein said magazine top wall has said auxiliary opening located adjacent said delivery opening, and said auxiliary magazine having a filler opening located above said discharge end thereof to provide for gravity feed of additional cartridges contained in said auxiliary magazine.

3. The magazine of claim 2 further characterized by spring means for driving said chain in one direction, said manually operable means for reversing said chain including a rotatable knob for manually restoring said spring means toward its biased condition, and said manually operable means for so moving said closure including a manually manipulated lever means normally biasing said closure to prevent additional cartridges from dropping into said chain pockets said lever being movable against said closure biasing means.

* * * * *